US010582575B2

(12) United States Patent
Kiyosawa et al.

(10) Patent No.: US 10,582,575 B2
(45) Date of Patent: Mar. 3, 2020

(54) HEATING COIL

(71) Applicant: NETUREN CO., LTD., Tokyo (JP)

(72) Inventors: Yutaka Kiyosawa, Tokyo (JP); Yutaka Sugiyama, Tokyo (JP); Yasuharu Ogawa, Tokyo (JP)

(73) Assignee: NETUREN CO., LTD., Tokyo (JP)

( * ) Notice: Subject to any disclaimer, the term of this patent is extended or adjusted under 35 U.S.C. 154(b) by 216 days.

(21) Appl. No.: 13/705,981

(22) Filed: Dec. 5, 2012

(65) Prior Publication Data

US 2013/0140299 A1 Jun. 6, 2013

(30) Foreign Application Priority Data

Dec. 5, 2011 (JP) ..... 2011-266331
Sep. 13, 2012 (JP) ..... 2012-201434

(51) Int. Cl.
*H05B 6/36* (2006.01)
*C21D 1/42* (2006.01)
(Continued)

(52) U.S. Cl.
CPC ..... *H05B 6/362* (2013.01); *C21D 1/42* (2013.01); *H05B 6/38* (2013.01); *H05B 6/42* (2013.01)

(58) Field of Classification Search
CPC ..... C21D 1/42; C30B 13/18; C30B 21/06
(Continued)

(56) References Cited

U.S. PATENT DOCUMENTS 2,493,950 A * 1/1950 Dow ..... B23K 13/00 219/617
2,714,648 A * 8/1955 Blok ..... H05B 6/362 200/80 A
(Continued)

FOREIGN PATENT DOCUMENTS

CN 1640197 7/2005
DE 3604537 A1 * 8/1987 ..... G01N 21/84
(Continued)

OTHER PUBLICATIONS

English translation of Office Action, dated Aug. 26, 2014, in corresponding CN Patent Application No. 201210513113.2.
(Continued)

*Primary Examiner* — Tu B Hoang
*Assistant Examiner* — Diallo I Duniver
(74) *Attorney, Agent, or Firm* — Wenderoth, Lind & Ponack, L.L.P.

(57) ABSTRACT

A heating coil includes a pair of linear lead portions adapted to be connected to a power supply, and a ring-shaped or coil-shaped head portion having end portions connected to the lead portions respectively. A flow path through which a cooling medium flows is formed inside the lead portions and the head portion. An outer circumferential surface of the head portion has a circular or elliptical cross section and is configured to face a heating target portion of an inner circumferential surface of a work extending, the heating target portion extending in a circumferential direction of the work. Each of the lead portions has a straight side portion in a plane intersecting a longitudinal direction of the lead portions, the straight side portions of the lead portions being arranged in proximity to each other.

14 Claims, 4 Drawing Sheets

(51) Int. Cl.
*H05B 6/42* (2006.01)
*H05B 6/38* (2006.01)

(58) Field of Classification Search
USPC ..... 219/635, 675, 677, 672, 617, 623, 656, 219/662
See application file for complete search history.

(56) References Cited

U.S. PATENT DOCUMENTS 3,531,612 A * 9/1970 Fernand ..... H05B 6/101 219/612
3,827,017 A * 7/1974 Keller ..... 336/62
4,184,135 A * 1/1980 Gupta et al. ..... 336/62
4,207,451 A * 6/1980 Tudbury ..... H05B 6/42 219/672
4,698,473 A 10/1987 Alcini et al.
4,942,279 A * 7/1990 Ikeda ..... 117/222
5,550,354 A * 8/1996 Kimura ..... H05B 6/362 219/638
5,987,054 A * 11/1999 Fishman ..... F27B 14/061 219/674

FOREIGN PATENT DOCUMENTS

| | | | |
|---|---|---|---|
| JP | 02267215 | A * | 11/1990 |
| JP | 04099218 | A * | 3/1992 |
| JP | 5-81263 | U | 11/1993 |
| JP | 5-081263 | U | 11/1993 |
| JP | 7-32499 | | 6/1995 |
| JP | 2540041 | Y2 | 4/1997 |
| JP | 2540041 | Y2 | 4/1997 |
| JP | 2000-199016 | | 7/2000 |
| JP | 3408982 | B2 | 3/2003 |
| JP | 2008-128420 | | 6/2008 |

OTHER PUBLICATIONS

English language translation of a Japanese Office Action dated Apr. 26, 2016 in counterpart Japanese Patent Application No. 2012-201434.

* cited by examiner

HEATING COIL

CROSS-REFERENCE TO RELATED APPLICATIONS

The present application claims priority from Japanese Patent Application No. 2011-266331 filed on Dec. 5, 2011, and Japanese Patent Application No. 2012-201434 filed on Sep. 13, 2012, the entire contents of which are incorporated herein by reference.

FIELD OF INVENTION

The present invention relates to a heating coil configured to heat a heating target portion to quench a work such as a mechanical component.

BACKGROUND

Heating coils are used to quench components of machines such as automobile bearings.

There are various types of heating coils. For example, a heating coil has a pair of lead plates connected to a power supply such as a high-frequency transformer, lead portions connected to the lead plates respectively, and a coil-shaped head portion connected to the lead portions. Inside the lead portions and the head portion, a flow path is continuously formed to allow cooling water to flow inside the lead portions and the head portion.

According to a first related art, a heating coil has a ring-shaped high-frequency heating coil, a pair of cylindrical power and water lead members connected to the heating coil, and lead plates connected to the power and water lead members respectively, and a high-frequency transformer is connected to the lead plates (see, e.g., JP5-081263U). According to a second related art, a heating coil has a rectangular pipe forming a coil-shaped heating conductor and linear power feeding conductor connected to end portions of the heating conductor, and end portions of the power feeding conductors are connected to a current transformer (see, e.g., JP3408982B2 and JP2540041Y2).

Generally, an electric conductive body has a portion through which an electric current flows easily, and a portion through which an electric current does not flow easily. For example, a direct current is apt to flow through a portion where resistance is small, and an alternating current is apt to flow through a portion where impedance is small (see, e.g., Katsuhiko Hori, "Kogyoyo Denki Kanetsu" (Industrial Electric Heating), The Energy Conservation Center, Japan, 1986).

Regardless of whether it is a direct current or an alternating current, an electric current supplied from a power supply passes through the shortest path in the conductive body.

In the first related art, each of the power and water lead members connected to the ring-shaped high-frequency heating coil has a shape of a circular cylindrical pipe. Thus, when the lead members are arranged in proximity to each other, electric current is concentrated in circular-arc portions of the lead members that are in proximity to each other. That is, the electric current density is high in the circular-arc portions that in the other portions of the lead members, so that efficiency of electric power transmission is low. To increase a quenching amount of a heating target portion from this condition, larger electric current may be supplied to the heating coil. However, due to magnetic force generated in the lead members arranged in mutual proximity, the lead members repel one another, causing an unnecessarily stress to the heating coil. In particular, when a work to be heated is small in inside diameter, the ring-shaped high-frequency heating coil is reduced in size, and a distance between the pair of the lead members is reduced accordingly. Thus, the heating coil is likely to be unduly stressed.

In the second related art, on the other hand, the coil-shaped heating conductor is a rectangular pipe. Thus, when the heating target portion is formed concavely on the inner circumferential surface of a work along a circumferential direction of the work, the heating target portion cannot be heated efficiently. That is, the coil-shaped heating conductors formed by a rectangular pipe is suitable for heating, for example, an axially extending heating target portion of an inner circumferential surface of a work. However, when heating, for example, a concave raceway surface on an inner circumference of an outer ring of a wheel rolling bearing, heat radiated from a linear outer circumferential portion of the rectangular pipe cannot heat the concave raceway surface efficiently.

SUMMARY

It is an object of the present invention to provide a heating coil capable of efficiently heating a circumferentially extending heating target portion on an inner circumferential surface of a work with high efficiency of electric power transmission.

According to an aspect of the present invention, a heating coil includes a pair of linear lead portions adapted to be connected to a power supply, and a ring-shaped or coil-shaped head portion having end portions connected to the lead portions respectively. A flow path through which a cooling medium flows is formed inside the lead portions and the head portion. An outer circumferential surface of the head portion has a circular or elliptical cross section and is configured to face a heating target portion of an inner circumferential surface of a work extending, the heating target portion extending in a circumferential direction of the work. Each of the lead portions has a straight side portion in a plane intersecting a longitudinal direction of the lead portions, the straight side portions of the lead portions being arranged in proximity to each other.

That is, a cross section of each of the lead portions has the straight side portion, and the straight side portions of the respective lead portions linear portions are arranged in proximity to each other. Thus, electric current flowing in the pair of lead portions is concentrated in the straight side portions, so that the efficiency of electric power transmission is high. Accordingly, a large electric current need not be applied to the heating coil to increase a quenching amount in the heating target portion. In other words, because of high efficiency of electric power transmission, large electric current need not to be applied to the lead portions. Consequently, repelling of the lead portions due to the magnetic force generated therein is suppressed, and the heating coil is prevented from being unduly stressed.

Further, because the outer circumferential surface of the head portion has a circular or elliptical cross section and is configured to face a heating target portion of an inner circumferential surface of a work extending in a circumferential direction of the work, heat radiated from the outer circumferential portion of the head portion is uniformly transmitted to the heating target portion, whereby the heating efficiency is improved.

According to another aspect of the present invention, each of the lead portions has a rectangular cross section taken along the plane intersecting the longitudinal direction of the lead portions, and one side of the rectangular cross section forms the straight side portion.

According to this configuration, the cross section of each lead portion is rectangular, i.e., a non-square rectangle or a square. Therefore, the lead portions can be manufactured easily, and one side of the rectangular form can be used as the straight side portion through which electric current flows in a concentrated manner, thereby allowing large electric current.

As compared with a circular or elliptical cross section, a rectangular cross section provides higher mechanical strength, and is therefore advantageous in terms of deformation resistance. For example, when a round pipe forming the head portion has an outside diameter a1 of 7 millimeters (mm) and an inside diameter a2 of 5 mm, the second moment of area of the round pipe is $\pi\times(a1^4-a2^4)/64=87.2$ $mm^4$. When a rectangular pipe forming the lead portion has an outer size of a1=a2=7 mm and an inner size of b1=b2=5 mm, the second moment of area of the rectangular pipe is $(a1\times a2^3-b1\times b2^3)/12=148.0$ $mm^4$. That is, a rectangular pipe has higher mechanical strength than a round pipe.

According to another aspect of the present invention, the work may be an outer ring of a wheel rolling bearing, an inner circumferential surface of the outer ring having a raceway surface, and the heating target portion may be the raceway surface. That is, one or more exemplary embodiments of the present invention provides a heating coil suitable for heating an outer ring of a wheel rolling bearing.

DETAILED DESCRIPTION

Hereinafter, exemplary embodiments of the invention will be described with reference to the drawings.

Figure 1:
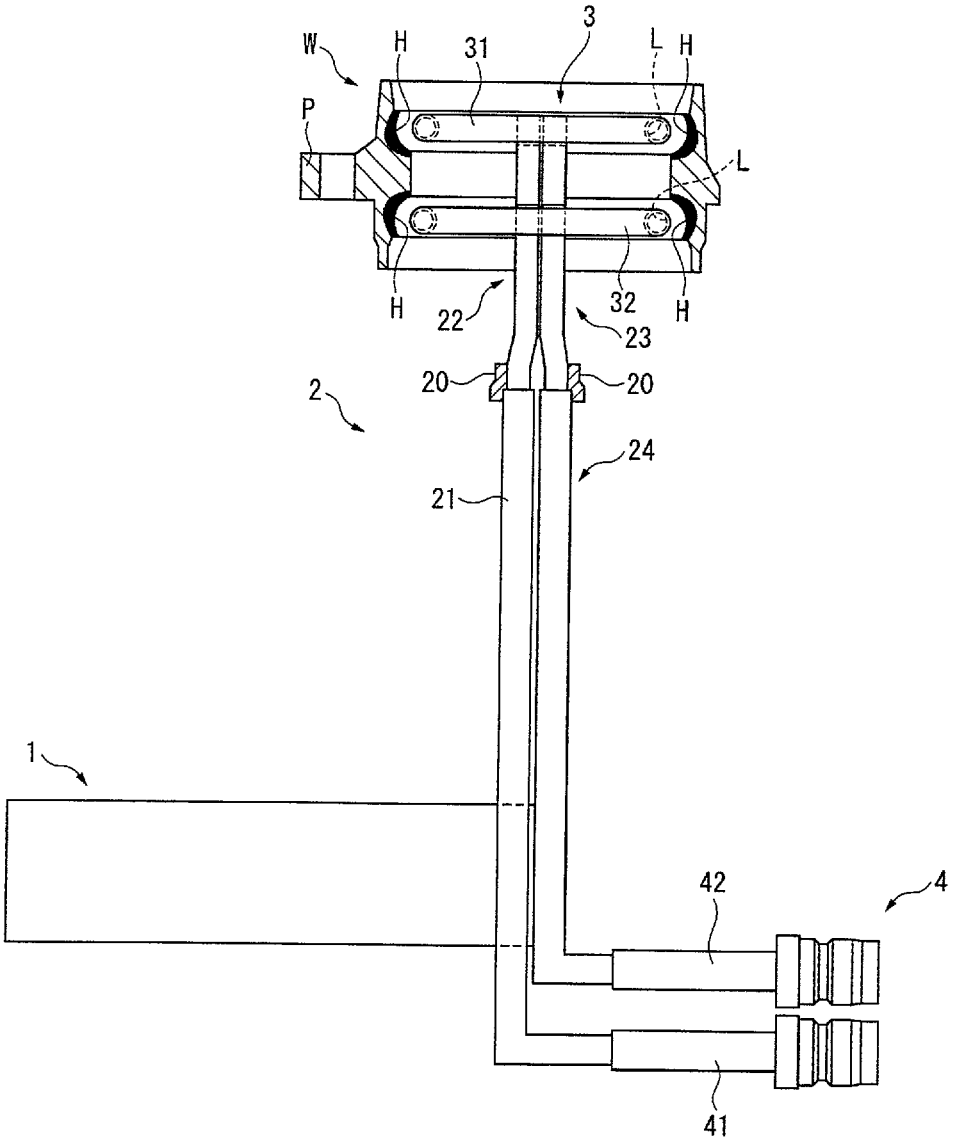
FIG. 1 is a front view of a heating coil according to an exemplary embodiment of the invention.

As illustrated in FIG. 1, a heating coil according to an exemplary embodiment of the present invention is adapted to perform high-frequency quenching on an outer ring W of a wheel rolling bearing (an example of a work).

The outer ring W has a flange portion and a cylindrical portion that are integrally formed, and raceway surfaces H (an example of a heating target portion) are formed on an inner circumferential surface of the cylindrical portion to extend along a circumferential direction. The flange portion has a protruded portion P.

The outer ring W is made of, e.g., a steel material such as bearing steel and carbon steel for machine structural use. Each of the raceway surfaces H has a concavely curved shape to support spherical rolling elements. Each of the raceway surfaces H is subjected to a heat treatment (quenching) by a heating coil such that a certain depth from the raceway surface H is treated.

The outer ring W forms a wheel rolling bearing together with an inner shaft (not shown). The inner shaft has a shaft portion and a flange integrally formed on an end part of the shaft portion. The spherical rolling elements are provided between the raceway surfaces H of the outer ring W and raceway surfaces formed on outer circumferential surface of the shaft portion. The wheel rolling bearing configured to rotatably support a wheel on a suspension of an automobile or the like. The outer ring W is supported by the suspension at the protruded portion P.

As illustrated in FIG. 1, the heating coil includes a pair of lead plates 1 connected to a power supply (not shown) such as a high-frequency transformer, a pair of linear lead portions 2 attached to the lead plates 1 respectively, a head portion 3 having two ring portions 31, 32, end portions of each of which are connected to an associated one of the lead portions 2, and cooling medium supply pipes 4, one end of each of which is connected to an associated one of the lead portions 2.

Each of the lead plates 1 is has a rectangular shape in a front view.

The lead portions 2 are formed by rectangular copper pipes, and include a pair of first lead portions 21 connected to the lead plates 1, a pair of second lead portions 22 each having one end connected to an associated one of the first lead portions 21 and the other end connected to the head portion 3, a pair of fourth lead portions 24 connected to the lead plates 1, and a pair of third lead portions 23 each having one end connected to an associated one of the fourth lead portions 24 and the other end connected to the head portion 3.

Each of the second lead portions 22 is partially inserted into the associated one of the first lead portions 21. Each of the third lead portions 23 is partially inserted into the associated one of the fourth lead portions 24. A reinforcing plate 20 is attached to a portion where the first lead portions 21 and the second lead portions 22 are connected. Another reinforcing plate 20 is attached to a portion where the third lead portions 23 and the second lead portions 24 are connected. The reinforcing plates 20 are arranged on opposite sides across the lead portions 2. The reinforcing plates 20 are brazed to the lead portions 2 with a metal that primarily contains silver. By attaching the reinforcing plates 20 to the lead portions 2, stress concentrated at the connection portion of the lead portions 2 is dispersed, so that breakage is prevented from occurring from a weak portion.

The reinforcing plates 20 are formed by bending their central portion to absorb the difference in surface-level between the first lead portions 21 and the second lead portions 22 and the difference in surface-level between the third lead portions 23 and the fourth lead portions 24.

Figure 2:
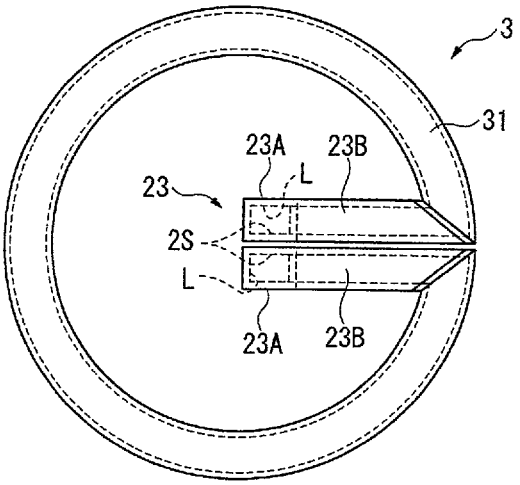
FIG. 2 is a plan view of a first ring portion.
Figure 3:
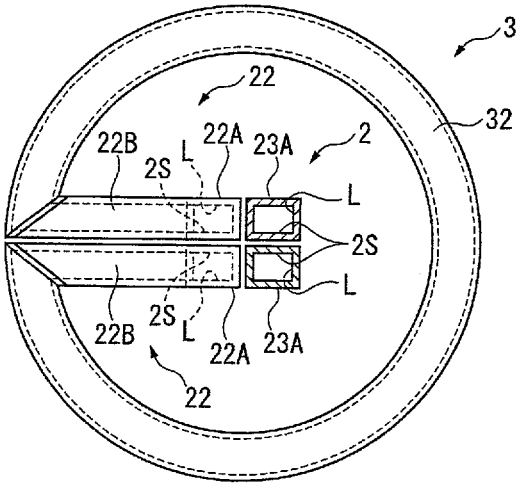
FIG. 3 is a plan view of a second ring portion.

FIG. 2 is a plan view of the first ring portion 31, and FIG. 3 is a plan view of the second ring portion 32.

As illustrated in FIGS. 1 to 3, each of the second lead portions 22 has a body part 22A connected to the associated one of the first lead portions 21 and extending in an axial direction parallel to an axial direction of the first lead portion 21, and a connecting part 22B formed integrally with the body part 22A and connected to the second ring portion 32.

An end portion of each of the body parts 22A connected to the associated one of the first lead portions 21 is curved. Each of the connecting parts 22B is formed by bending such that each of the connecting parts 22B and the associated one of the body parts 22A form a substantially right angle.

Each of the third lead portions 23 has a body part 23A connected to an associated one of the fourth lead portions 24 and extending in an axial direction parallel to an axial direction of the fourth lead portion 24, and a connecting part 23B formed integrally with the body part 23A and connected to the first ring portion 31.

An end portion of each of the body parts 23A connected to an associated one of the fourth lead portions 24 is curved.

Each of the connecting parts 23B is formed by bending such that each of the connecting parts 23B and the associated one of the fourth lead portions 24 form a substantially right angle.

Each of the first ring portion 31 and the second ring portion 32 is formed by a cylindrical copper pipe.

As illustrated in FIG. 2, the first ring portion 31 is arranged such that a radial direction of the first ring portion 31 is orthogonal to the axial direction of the body parts 23A of the third lead portions 23. An outer circumferential surface of the first ring portion 31 is has a circular cross section so as to face the associated one of the concave raceway surfaces H (see FIG. 1). The outer circumferential surface of the first ring portion 31 may be formed to have an elliptical cross section.

Both ends of the first ring portion 31 are opened, and are connected to the connecting parts 23B of the third lead portions 23 by welding. The connecting parts 23B are arranged in proximity to each other.

As illustrated in FIG. 3, the second ring portion 32 is arranged such that a radial direction of the second ring portion 32 is orthogonal to the axial direction of the body parts 22A of the second lead portions 22. An outer circumferential surface of the second ring portion 32 has a circular cross section so as to face the associated one of the concave raceway surfaces H (see FIG. 1). The outer circumferential surface of the second ring portion 32 may be formed to have an elliptical cross section.

Both ends of the second ring portion 32 are opened, and are connected to the connecting parts 22B of the pair lead portions 22 by welding. The connecting parts 22B are placed in proximity to each other.

Next, the cross sectional shape of the lead portion 2 will be described.

Each of the first lead portions 21, the second lead portions 22, the third lead portions 23, and the fourth lead portions 24 has a rectangular cross section, forming a rectangular flow path thereinside. The short side portions of the rectangular cross sections of the first lead portions 21 and the second lead portions 22 are parallel to the short side portions of the rectangular cross sections of the third lead portions 23 and the fourth lead portions 24. The cross section of each of the first lead portions 21 and the cross section of each of the second lead portions 22 are geometrically similar. The cross section of each of the third lead portion 23 and the cross section of each of the fourth lead portions 24 are geometrically similar.

Near the head portion 3, one of the long side portions of one of the second lead portions 22 and one of the long side portions of the other second lead portion 22 are closely arranged to each other, and these long side portions arranged in proximity to each other are straight side portions 2S according to this exemplary embodiment. Similarly, near the head portion 3, one of the long side portions of one of the third lead portions 23 and one of the long side portions of the other third lead portion 23 are closely arranged to each other, and these long side portions arranged in proximity to each other are also straight side portions 2S according to this exemplary embodiment.

The cooling medium supply pipes 4 include pipes 41 each having one end connected to the associated one of the first lead portions 21, and pipes 42 each having one end connected to the associated one of the fourth lead portions 24. A cooling medium supply source (not shown) is connected to the other ends of the pipes 41, 42. The cooling medium supply source supplies, e.g., cooling water to the lead portions 2 and the head portion 3 as a cooling medium to cool the inside of the heating coil during quenching. The heating coil may be configured such that the cooling water sent to the lead portions 2 and the head portion 3 is returned to the cooling medium supply source through the pipes 41, 42 and reused.

Next, a quenching method using a heating coil will be described.

First, the heating coil is set with respect to an outer ring W of a wheel rolling bearing (an example of a work). The heating coil is positioned such that the first ring portion 31 and the second ring portion 32 face the respective raceway surfaces H.

Then, cooling water is supplied to the fourth lead portions 24, the third lead portions 23 and the first ring portion 31 through the pipes 42. Likewise, cooling water is supplied to the first lead portions 21, the second lead portions 22 and the second ring portion 32 through the pipes 41. Next, high-frequency electric current is applied to the first ring portion 31 and the second ring portion 32 through the pair of lead plates 1 from a power supply including a high-frequency transformer.

Heat is generated from the first ring portion 31 and the second ring portion 32 by the high-frequency electric current, whereby the raceway surfaces H (a heating target portion) are heated, and the work is quenched.

The high-frequency electric current flows through the fourth lead portions 24, the third lead portions 23 and the first ring portion 31, and also through the first lead portions 21, the second lead portions 22 and the second ring portion 32. The electric current supplied from the power supply passes the shortest path through the conductors, i.e., the lead portions 2 and the head portion 3. Accordingly, the electric current is concentrated in the neighboring straight side portions 2S of the second lead portions that are arranged side by side, and in the neighboring straight side portions 2S of the third lead portions 23 that are arranged side by side.

The exemplary embodiment is advantageous in the following aspects.

The heating coil includes the pair of linear lead portions 2 connected to the power supply, and the ring-shaped head portion 3 having end portions connected to the lead portions 2 respectively. The outer circumferential surface of the head portion 3 has a circular or elliptical cross section so as to face a concave raceway surface H formed along a circumferential direction on an inner circumferential surface of the outer ring W of a wheel rolling bearing. Thus, heat radiated from the outer circumferential portion of the head portion 3 is uniformly transmitted to the concave raceway surface H, thereby improving heating efficiency and quenching accuracy.

The pair of linear lead portions 2 includes, for example, the pair of second lead portions 22 and the pair of third lead portions 3. Each of the second lead portions 22 has the straight side portion 2S, and the straight side portions 2S are arranged in proximity to each other in a plane intersecting with a longitudinal direction of the second lead portions 22. Likewise, Each of the third lead portions 23 has the straight side portion 2S, and the straight side portions 2S are arranged in proximity to each other in a plane intersecting with a longitudinal direction of the third lead portions 23. Electric current flowing through the second lead portions 22 and the third lead portions 23 is concentrated in the respective straight side portions 2S to flow along the shortest path. Thus, the efficiency of electric power transmission is high. That is, according to the first related art described above, because each of the lead portions is formed using a round pipe, a portion of the lead portion through which electric current flows in a concentrated manner is a round portion, so that a sufficient area for the electric current to flow cannot be provided. According to this exemplary embodiment, the portion through which the electric current flows in a concentrated manner is the straight side portion 2S. Thus, the area of the portion through which the electric current flows in a concentrated manner can be increased as compared with the first related art, with the same wall thickness of the lead portion, whereby the efficiency of electric power transmission is improved. Accordingly, large electric current need not be applied to the lead portions 2. Consequently, repelling of the lead portions by magnetic forces generated in the second lead portions 22 and in the third lead portions 23 is suppressed, and the heating coil is prevented from being unduly stressed.

The cross section of each of the second lead portions 22 and the third lead portions 23 taken along the plane intersecting the longitudinal direction of the lead portions is rectangular, and one of the long side portions of the rectangular cross section serves as the straight side portion 2S. Thus, the lead portions can manufactured easily. Also, a large amount of electric current can flow through the lead portions as compared with a case where a short side portion of the rectangular cross section serves as a straight side portion 2S.

The cross section of each of the first lead portions 21 and the cross section of each of the second lead portions 22 connected to the first lead portions 21 are geometrically similar. Likewise, the cross section of each of the fourth lead portions 24 and the cross section of each of the third lead portions 23 are geometrically similar. Accordingly, the end portion of each of the second lead portions 22 can be accurately inserted and connected to the associated one of the first lead portions 21, and also, the end portion of each of the third lead portions 23 can be accurately inserted and connected to the associated one of the fourth lead portions 24, whereby cooling water is prevented from leaking from the connection portion between the first lead portions 21 and the second lead portions 22 and the connection portion between the third lead portions 23 and the fourth lead portions 24.

The reinforcing plates 20 are arranged to face the connection portion between the first lead portions 21 and the second lead portions 22 and the connection portion between the third lead portions 23 and the fourth lead portions 24, respectively, and these connection portions and the respective reinforcing plates 20 are attached together by brazing. Consequently, fatigue breaking due to high-frequency vibrations can be prevented from occurring in the connection portion between the first lead portions 21 and the second lead portions 22 and in the connection portion between the third lead portions 23 and the fourth lead portions 24.

The raceway surfaces H formed on the inner circumferential surface of the outer ring W of the wheel rolling bearing is heated by the heating coil described above. Thus, the quenching of the outer ring W can be performed accurately.

While the present invention has been described with reference to a certain exemplary embodiment thereof, the scope of the present invention is not limited to the exemplary embodiment described above, and it will be understood by those skilled in the art that various changes and modifications may be made therein without departing from the scope of the present invention as defined by the appended claims.

Figure 4A:
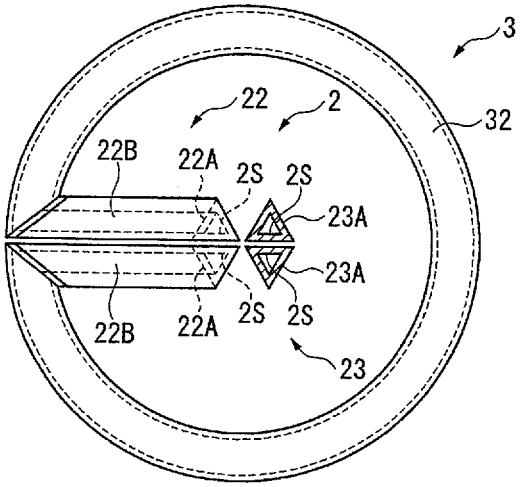
FIGS. 4A and 4B are plan views of modified examples.
Figure 4B:
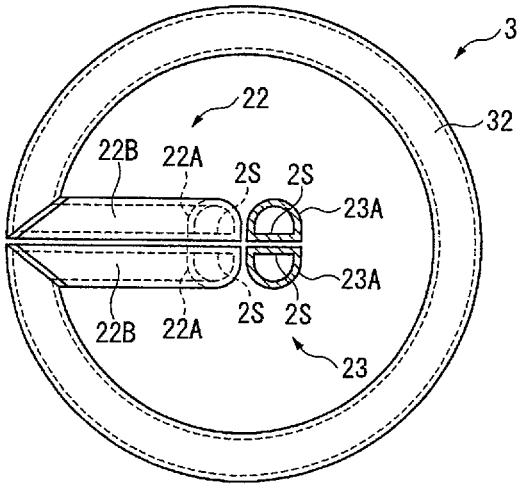

For example, the cross sectional shape of each of the second lead portions 22 and the third lead portions 23 is not limited to a non-square rectangle, and may be a square or a non-rectangular shape, in so far as the cross section of each the lead portions has the straight side portion 2S. For example, as illustrated in FIG. 4A, the cross section of each of the second lead portions 22 and the third lead portions 23 may be triangular, such that the neighboring sides of the paired lead portions serve as the straight side portions 2S. In another example, as illustrated in FIG. 4B, the cross section of each of the second lead portions 22 and the third lead portions 23 may have the straight side portion 2S and a round portion connecting the both ends the straight side portion 2S.

Further, while the head portion 3 has two ring portions 31, 32 in the exemplary embodiment described above, the number of the ring portions is not limited, and may be one, or three or more. However, to heat a heating target portion, the number of the ring portions is preferably equal to the number of the heating target portions, e.g., the number of raceway surfaces H of the outer ring W.

Alternatively, the head portion 3 is not limited to the ring shaped configuration, and may be a coil member formed by spirally arranging a single pipe member.

Further, the work is not limited to the outer ring W described above, and the heating target portion is not limited to the raceway surfaces H formed on the inner circumferential surface of the outer ring W. In so far long as the heating target portion is configured to extend along a circumferential direction on the inner circumferential surface of the work, the heating part portion, e.g., the raceway surface H need to be formed in a concave manner, and the structure of the work is not limited to a specific structure. However, when the raceway surface H is formed concavely along a circumferential direction like in the exemplary embodiment described above, the distance between the raceway surface H and the outer circumferential surface of the head portion 3 is uniform, and thus, heating can be performed in a more uniform manner.

Figure 5:
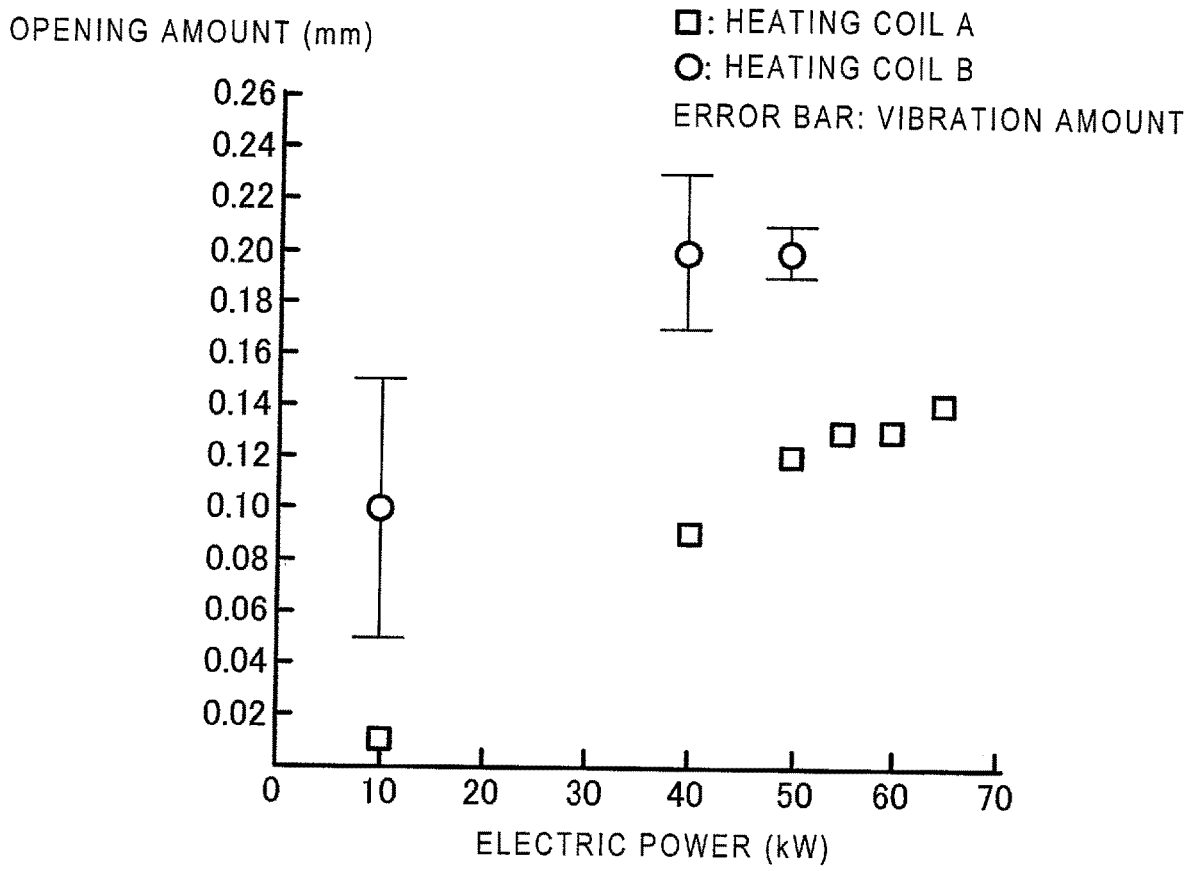
FIG. 5 is a graph showing results of measuring opening amounts of ring portions of heating coils.

A heating coil A and a heating coil B were prepared, and were connected to a high-frequency power supply to perform quenching on the raceway surface of the outer ring of the wheel rolling bearing. The heating coil A was provided by forming each of the lead portions by a rectangular pipe having a rectangular cross section, and such that the long side portions of the respective lead portions are arranged in proximity to each other. The external size of the rectangular cross section had a short side of 7 mm and a long side of 9 mm, and the wall thickness of the rectangular pipe was 1.5 mm (the second moment of area was 225.3 $mm^4$). The heating coil B was provided by forming each of the lead portions by a round pipe having a circular cross section. The outside diameter of the circular cross section was 7 mm, and the wall thickness of the round pipe was 1 mm (the second moment of area thereof was 87.1 $mm^4$). The configuration of the ring portion opposed to the raceway surface was the same for both of the heating coils A and B. For each of the heating coils A and B, an opening amount between end portions of the ring portion was measured while performing the quenching of the raceway surface with different electric power, i.e., with different electric current. FIG. 5 illustrates the results of the measurement of the opening amount.

As shown in FIG. 5, the opening amount between the end portions of the ring portion of the heating coil A was smaller that of the heating coil B. Also the vibration amount was suppressed in the heating coil A as compared with the heating coil B. The lead portion of the heating oil A, which is formed by a rectangular pipe, is large in the second moment of area and high in mechanical strength as compared with the lead portion of the heating coil B, which is formed by a round pipe. Accordingly, the opening amount and the vibrations of the ring portion can be reduced.

Moreover, as a result of measuring power loss due to the heating coil with electric power of 50 kilowatts (kW), it was confirmed that the power loss due to the heating coil B was 9.18 kW, whereas the power loss due to the heating coil A is 8.06 kW. That is, it was confirmed that the efficiency of electric power transmission of the lead portion of the heating coil A, which formed by a rectangular pipe, was relatively high.

What is claimed is:

1. A heating coil comprising:

a head having a ring shape or a coil shape around a vertical central axis and having a first end and a second end;

a first lead adapted to be connected to a power supply, the first lead having a first linear portion connected to the first end of the head and a second portion extending from the first linear portion, the first linear portion of the first lead extending inwardly from a radially inner side of the first end of the head, and the second portion of the first lead extending in a direction parallel to the vertical central axis of the head; and a second lead adapted to be connected to the power supply, the second lead having a first linear portion connected to the second end of the head and a second portion extending from the first linear portion, the first linear portion of the second lead extending inwardly from a radially inner side of the second end of the head, and the second portion of the second lead extending in a direction parallel to the vertical central axis of the head, wherein a flow path through which a cooling medium is to flow is formed inside the first lead, the head and the second lead such that the cooling medium inside the first linear portion of the first lead and the first linear portion of the second lead flows along a longitudinal direction of the first linear portion of the first lead and a longitudinal direction of the first linear portion of the second lead, wherein a cross section of an outer circumferential surface of the head taken along a plane that passes through and is parallel to the vertical central axis of the head has a circular or elliptical shape and is configured to face a heating target portion of an inner circumferential surface of a work, the heating target portion extending in a circumferential direction of the work, wherein the first linear portion of the first lead has a straight side extending parallel to the vertical central axis of the head, the first linear portion of the second lead has a straight side extending parallel to the vertical central axis of the head, and the straight side of the first linear portion of the first lead and the straight side of the first linear portion of the second lead are arranged in proximity to each other, wherein the first linear portion of the first lead is welded to the first end of the head and the first linear portion of the second lead is welded to the second end of the head, and wherein a first weld line where the first linear portion of the first lead is welded to the first end of the head reaches a radially outermost circumference of the head and a second weld line where the first linear portion of the second lead is welded to the second end of the head reaches the radially outermost circumference of the head, and wherein the first weld line and the second weld line form a V-shape.

2. The heating coil according to claim 1, wherein a cross section of each of the first lead and the second lead is rectangular, and wherein one side of the rectangular cross section of the first lead forms the straight side of the first lead and one side of the rectangular cross section of the second lead forms the straight side of the second lead.

3. The heating coil according to claim 2, wherein the work is an outer ring of a wheel rolling bearing, an inner circumferential surface of the outer ring having a raceway surface, and the heating target portion is the raceway surface, and the outer circumferential surface of the head and the raceway surface are coaxial.

4. The heating coil according to claim 1, wherein the first lead and the second lead, at a location toward a center of the head, are bent and extend in a direction parallel to the vertical central axis of the head.

5. The heating coil according to claim 1, wherein the first lead and the second lead extend parallel to each other from the radially inner sides of the first end and the second end, respectively, of the head.

6. The heating coil according to claim 1, wherein the straight sides of the first lead and the second lead are arranged to face each other and are parallel to each other.

7. The heating coil according to claim 1, wherein the head is a single piece defining the flow path formed in the head.

8. The heating coil according to claim 1, wherein a height of the flow path in the head, a height of the flow path in the first linear portion of the first lead, and a height of the flow path in the first linear portion of the second lead are equal to each other.

9. The heating coil according to claim 1, further comprising a second head, a third lead, and a fourth lead.

10. The heating coil according to claim 1, further comprising:

a third lead connected to the first lead;

a fourth lead connected to the second lead; and a reinforcing plate attached to the first lead, the second lead, the third lead and the fourth lead at a position where the third lead connects to the first lead and the fourth lead connects to the second lead.

11. The heating coil according to claim 1, wherein a cross section of the first lead and the second lead is triangular or "D" shaped.

12. A heating coil comprising:

a first head having a ring shape or a coil shape around a vertical central axis and having a first end and a second end;

a second head having a ring shape or a coil shape around the vertical central axis and having a first end and a second end;

a first lead adapted to be connected to a power supply, the first lead having a first linear portion connected to the first end of the first head and a second portion extending from the first linear portion, the first linear portion of the first lead extending inwardly from a radially inner side of the first end of the first head, and the second portion of the first lead extending in a direction parallel to the vertical central axis of the first and second heads;

a second lead adapted to be connected to the power supply, the second lead having a first linear portion connected to the second end of the first head and a second portion extending from the first linear portion, the first linear portion of the second lead extending inwardly from a radially inner side of the second end of the first head, and the second portion of the second lead extending in a direction parallel to the vertical central axis of the first and second heads;

a third lead adapted to be connected to the power supply, the third lead having a first linear portion connected to the first end of the second head and a second portion extending from the first linear portion, the first linear portion of the third lead extending inwardly from a radially inner side of the first end of the second head, and the second portion of the third lead extending in a direction parallel to the vertical central axis of the first and second heads; and a fourth lead adapted to be connected to the power supply, the fourth lead having a first linear portion connected to the second end of the second head and a second portion extending from the first linear portion, the first linear portion of the fourth lead extending inwardly from a radially inner side of the second end of the second head, and the second portion of the fourth lead extending in a direction parallel to the vertical central axis of the first and second heads, wherein a first flow path through which a cooling medium is to flow is formed inside the first lead, the first head and the second lead such that the cooling medium inside the first linear portion of the first lead and the first linear portion of the second lead flows along a longitudinal direction of the first linear portion of the first lead and a longitudinal direction of the first linear portion of the second lead, wherein a second flow path through which a cooling medium is to flow is formed inside the third lead, the second head and the fourth lead such that the cooling medium inside the first linear portion of the third lead and the first linear portion of the fourth lead flows along a longitudinal direction of the first linear portion of the third lead and a longitudinal direction of the first linear portion of the fourth lead, wherein the first and second heads are positioned at different heights along the vertical central axis with respect to each other, wherein a cross section of an outer circumferential surface of the first head taken along a plane that passes through and is parallel to the vertical central axis has a circular or elliptical shape and is configured to face a first heating target portion of an inner circumferential surface of a work, the first heating target portion extending in a circumferential direction of the work, wherein a cross section of an outer circumferential surface of the second head taken along the plane that passes through and is parallel to the vertical central axis has a circular or elliptical shape and is configured to face a second heating target portion of the inner circumferential surface of the work, the second heating target portion extending in the circumferential direction of the work, wherein the first linear portion of the first lead has a straight side extending parallel to the vertical central axis, the first linear portion of the second lead has a straight side extending parallel to the vertical central axis, and the straight side of the first linear portion of the first lead and the straight side of the first linear portion of the second lead are arranged in proximity to each other, and wherein the first linear portion of the third lead has a straight side extending parallel to the vertical central axis, the first linear portion of the fourth lead has a straight side extending parallel to the vertical central axis, and the straight side of the first linear portion of the third lead and the straight side of the first linear portion of the fourth lead are arranged in proximity to each other, wherein the first linear portion of the first lead is welded to the first end of the first head and the first linear portion of the second lead is welded to the second end of the first head, and wherein a first weld line where the first linear portion of the first lead is welded to the first end of the first head reaches a radially outermost circumference of the first head and a second weld line where the first linear portion of the second lead is welded to the second end of the first head reaches the radially outermost circumference of the first head, wherein the first linear portion of the third lead is welded to the first end of the second head and the first linear portion of the fourth lead is welded to the second end of the second head, and wherein a third weld line where the first linear portion of the third lead is welded to the first end of the second head reaches a radially outermost circumference of the second head and a fourth weld line where the first linear portion of the fourth lead is welded to the second end of the second head reaches the radially outermost circumference of the second head, and wherein the first weld line and the second weld line form a V-shape, and the third weld line and the fourth weld line form a V-shape.

13. The heating coil according to claim 12, wherein an entire bottom-most portion of the outer circumferential surface of the first head is located on a first plane, and an entire bottom-most portion of the outer circumferential surface of the second head is located on a second plane that is different than the first plane.

14. The heating coil according to claim 12, wherein the first head and the second head have a substantially same outer diameter.

* * * * *